US009905390B2

(12) United States Patent
Xiang

(10) Patent No.: US 9,905,390 B2
(45) Date of Patent: Feb. 27, 2018

(54) COOLING MECHANISM FOR HIGH-BRIGHTNESS X-RAY TUBE USING PHASE CHANGE HEAT EXCHANGE

(71) Applicant: Xiaodong Xiang, Danville, CA (US)

(72) Inventor: Xiaodong Xiang, Danville, CA (US)

( * ) Notice: Subject to any disclaimer, the term of this patent is extended or adjusted under 35 U.S.C. 154(b) by 160 days.

(21) Appl. No.: 14/888,690

(22) PCT Filed: May 5, 2014

(86) PCT No.: PCT/US2014/036756
§ 371 (c)(1),
(2) Date: Nov. 2, 2015

(87) PCT Pub. No.: WO2014/179792
PCT Pub. Date: Nov. 6, 2014

(65) Prior Publication Data

US 2016/0064176 A1 Mar. 3, 2016

Related U.S. Application Data

(60) Provisional application No. 61/854,863, filed on May 3, 2013.

(51) Int. Cl.
*H01J 35/12* (2006.01)
*H05G 1/02* (2006.01)
*H01J 35/14* (2006.01)

(52) U.S. Cl.
CPC ..... *H01J 35/12* (2013.01); *H01J 35/14* (2013.01); *H05G 1/025* (2013.01);
(Continued)

(58) Field of Classification Search
CPC .... H01J 35/12; H01J 35/14; H01J 2235/1204; H01J 2235/1279; H01J 2235/127; H01J 2235/1287; H01J 2235/1291; H01J 2235/1295; H01J 2235/1262; H05G 1/02; H05G 1/025
(Continued)

(56) References Cited

U.S. PATENT DOCUMENTS 5,052,034 A 9/1991 Schuster
5,299,249 A 3/1994 Burke et al.
(Continued)

OTHER PUBLICATIONS

International Search Report in the parent PCT application No. PCT/US2014/036756, dated Sep. 8, 2014.
(Continued)

*Primary Examiner* — Jurie Yun
(74) *Attorney, Agent, or Firm* — Chen Yoshimura LLP

(57) ABSTRACT

A mechanism for cooling the anode of an x-ray tube using a phase change material to transfer heat away from the anode. The x-ray tube is joined to a sealed heat exchange chamber which contains a liquid metal as a liquid to vapor phase change material (L-V PCM). The back side of the anode is exposed to an interior of the heat exchange chamber, and a jet sprayer inside the heat exchange chamber sprays a liquid of the metal onto the back side of the heated anode. The L-C PCM evaporates on that surface to carry away the heat, and the vapor then condenses back into the liquid on the cool surfaces of the heat exchange chamber. The surfaces of the heat exchange chamber may be cooled by convection cooling. Optionally, pipes containing a circulating cooling fluid may be provide inside the heat exchange chamber.

16 Claims, 2 Drawing Sheets

(52) U.S. Cl.
CPC . *H01J 2235/1204* (2013.01); *H01J 2235/127* (2013.01); *H01J 2235/1225* (2013.01); *H01J 2235/1279* (2013.01)

(58) Field of Classification Search
USPC ..... 378/141, 199, 200
See application file for complete search history.

(56) References Cited

U.S. PATENT DOCUMENTS

| | | | |
|---|---|---|---|
| 6,580,780 | B1 | 6/2003 | Miller |
| 2006/0133577 | A1 | 6/2006 | Saint-Martin et al. |
| 2007/0098143 | A1 | 5/2007 | Thangamani et al. |
| 2007/0230663 | A1 | 10/2007 | Anno |
| 2008/0302511 | A1 | 12/2008 | Kragt et al. |

OTHER PUBLICATIONS

IPRP in the parent PCT application No. PCT/US2014/036756 dated Nov. 3, 2015.

COOLING MECHANISM FOR HIGH-BRIGHTNESS X-RAY TUBE USING PHASE CHANGE HEAT EXCHANGE

FIELD OF THE INVENTION

The present invention relates to high brightness x-ray sources. In particular, it relates to a cooling mechanism for high brightness x-ray sources.

BACKGROUND OF THE INVENTION

Conventional x-ray sources generate the x-ray by using electron beam to excite an anode to generate x-ray emissions. Almost all of the power of the electron beam (e.g. 99%) is converted to heat in the process. A specific power density of 1 W/$\mu m^2$ and a total power of 100 W are typical specifications for anodes of state of the art stationary micro-focus x-ray tubes. In micro-focus x-ray tubes, the area of the anode hit by the electron beam (the focal spot) is very small, on the order of tens of microns, to achieve a small source size for high-resolution x-ray imaging. The amount of heat generated can be spread to a volume of about 1 $mm^3$ of the anode by metal thermal conduction mechanism without melting the center of the anode. However, the blackbody radiation rate alone on the surface of this small volume is not enough to radiate out this power to the outside radiation absorber cooled by water or air. Heat conduction to a larger area of radiation has to go through a long metal thermal conduction pass, which cannot transfer the amount of heat without causing significant temperature rise which can melt the spot hit by the electron beam. A rotating anode allows the heat to be distributed on a much larger area to avoid melting the anode. A specific power density of $2\times10^{-2}$ W/$\mu m^2$ and a total power of 10 kW are typical specifications for a state of the art rotating anode. For the same reason, the power density cannot be further increased for desired higher x-ray brilliance. Most conventional devices apply liquid convection methods (including liquid metal and water) to cool the anode. However, liquid convection heat exchange coefficient is not high enough to transfer the amount of heat without causing significant temperature rise that can melt the spot hit by the electron beam.

SUMMARY OF THE INVENTION

In embodiments of the present invention, a phase change heat exchange mechanism is used to provide heat transfer to match the heat impedance between the small surface of heated metallic anode and the large blackbody radiation or convection heat transfer surfaces. As a consequence, these designs allow the brightness of x-ray source to increase dramatically and at the same time increase the x-ray tube lifetime significantly.

In some embodiment, jet boiling evaporation or thin film evaporation phase change thermal exchange methods are used as a thermal transfer mechanism to match thermal impedance of a small e-beam heated area of metallic anode and large area of radiation cooling or convection cooling surfaces without any solid or liquid connections.

To achieve these and other advantages and in accordance with the purpose of the present invention, as embodied and broadly described, the present invention provides an x-ray generator which includes: a cathode for emitting an electron beam; an anode; alignment and focusing units for focusing and directing the electron beam onto the anode; a sealed x-ray tube enclosing the cathode, the anode and the alignment and focusing units; a sealed heat exchange chamber joined to the x-ray tube, wherein the anode either forms a section of a wall of the heat exchange chamber or is in thermal contact with a section of a wall of the heat exchange chamber; a metal as a liquid to vapor phase change material disposed inside the heat exchange chamber; and a delivery mechanism for delivering a liquid of the metal onto the section of the wall of the heat change chamber.

DETAILED DESCRIPTION OF THE PREFERRED EMBODIMENTS

Embodiments of the present invention provide a mechanism for cooling the anode of an x-ray tube using a phase change material to transfer heat away from a back side of the anode. Since heat exchange flux can reach above $10^7$ W/$m^2$ in jet boiling evaporation methods using water or certain liquid metals and in thin film evaporation methods using liquid metals, these phase change heat exchange methods can be used as a thermal transfer mechanism to match thermal impedance of a small e-beam heated area of metallic anode and a large area of radiation-cooled or convection-cooled surfaces without any solid or liquid connections.

Figure 1:
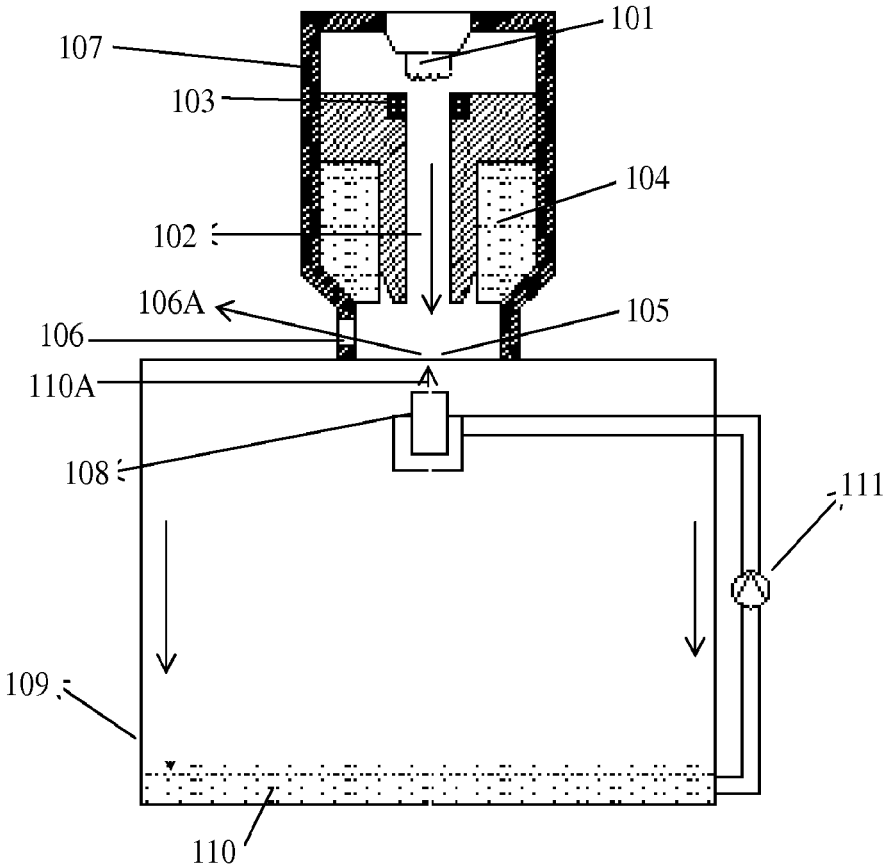
FIG. 1 schematically illustrates an x-ray generator system with a cooling mechanism according to an embodiment of the present invention.

FIG. 1 schematically illustrates an x-ray source according to a first embodiment of the present invention, where a phase change heat exchange method is used to cool the anode in the x-ray source. The x-ray source may be a micro-focus x-ray tube. The cathode 101 emits an electron beam 102, which is aligned by the alignment magnet unit 103, and further focused by the electromagnet unit (objective lens) 104 onto a small area of a stationary anode 105. As the electron beam hits the anode 105, the anode emits an x-ray 106A which exit the x-ray window 106 of the x-ray tube. All of the above components are enclosed in a vacuum tube (enclosure) 107. The cathode 101 and the anode 105 are connected to appropriate electrical voltages (not shown in the drawing).

The spot of the anode hit by the electron beam and nearby areas of the anode will be heated up to a very high temperature (e.g. 1000 C or higher) and can dissipate the heat by radiation. The radiation energy can exit the vacuum tube through radiation transparent enclosure 107. This energy can be dissipated by an outside radiation absorbing unit (not shown), which can further be cooled by convection methods.

In this embodiment, to provide enhanced cooling, the vacuum tube 107 is joined to a phase transition heat exchange chamber 109, where the anode 105 is mounted on a common wall between the vacuum tube and the heat exchange chamber so that the back side of the anode is exposed to the interior of the heat exchange chamber. The heat flux from the back side of the anode 105, i.e. the side facing away from the cathode, is transferred to a much larger surface of the walls of the heat exchange chamber 109 by a phase change mechanism. To accomplish this, a jet sprayer 108 located inside the heat exchange chamber 109 ejects a liquid jet 110A onto the back side of the heated spot of the anode 105, and the liquid evaporates on that surface to carry away the heat. The vapor then condenses back into the liquid form on the cool inside surfaces of the phase transition heat exchange chamber 109. The condensation falls to the bottom of the chamber 109 as indicated by the arrows along the side walls, and the accumulated liquid 110 is cycled by a pump 111 to the jet sprayer 108. The pump 111 and the related piping can be disposed inside or outside of the heat exchange chamber 109.

The liquid is a liquid to vapor phase change material (L-V PCM) chosen for heat exchange suitable for high temperature applications. Suitable materials include metals such as sodium (Na), potassium (K), tin (Sn), etc., and their alloys. The enclosure 109 should be kept sealed without any other liquid or air except for the L-V PCM inside.

Sprayers for spraying liquid metal are known; any suitable sprayer can be used for this embodiment. Using a sprayer can ensure that a desired amount of liquid metal is delivered to the hot surface. In the example of FIG. 1, the anode is oriented such that its back surface is disposed horizontally at the top of the heat exchange chamber, and the sprayer is located just below the back surface of the anode. In another example, the anode may be oriented such that its back surface is vertical or near vertical. In yet another example, the back surface of the anode is located near the bottom of the heat exchange chamber, a reservoir is provided to contain the liquid PCM, and the liquid is pumped to a sprayer located above the anode.

Further, beside jet sprayers, other delivery mechanisms can also be used to deliver the phase change material to the anode for evaporation. For example, a falling film method may be used to form a thin film of liquid metal on the back side of the anode when it is oriented vertically or near vertically.

The enclosure 109 of the chamber may be cooled from the outside by convection methods not shown in the drawing, such as forced air cooling, etc.

Figure 3:
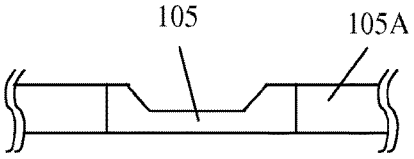
FIG. 3 schematically illustrates the anode used in the first or second embodiment.
Figure 3A:
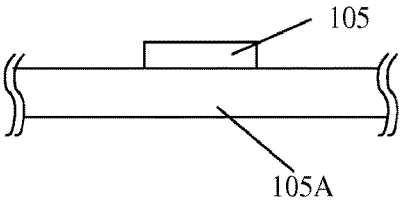

The structure of the anode 105 in one implementation is shown in more detail in FIG. 3. The anode 105 is a piece of metal which forms a part of the common wall 105A between the x-ray tube enclosure and the heat exchange chamber enclosure. The anode may be thinner in an area 105A near where the electron beam hits than in other portions of the wall, in order to enhance heat transfer from the front side of the anode to the back side. In this implementation, the anode itself forms a part of the enclosure of the heat exchange chamber. Alternatively, as shown in FIG. 3A, the anode 105 may be mounted on a metal plate 105A that forms a part of the enclosure, and the liquid PCM is sprayed onto the back side of the plate. Heat is transferred from the anode 105 to the backside of the plate 105B where the liquid metal is spray onto. A variation of the structure of FIG. 3A is that the anode 105 is mounted in an indentation of the plate 105B.

Figure 2:
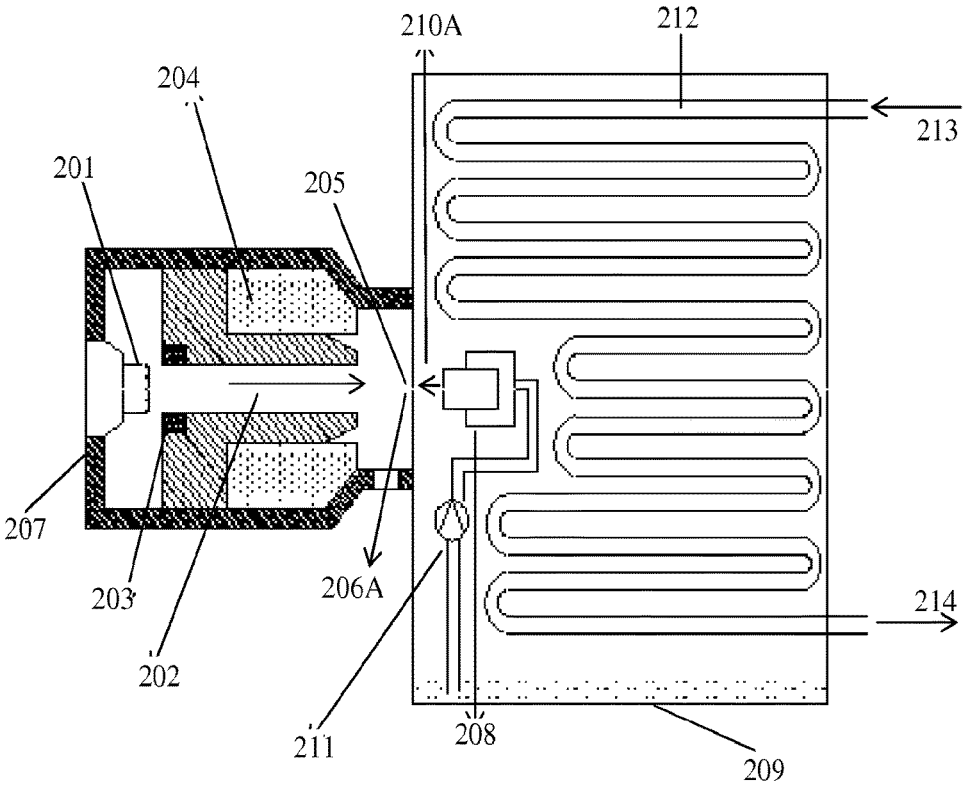
FIG. 2 schematically illustrates an x-ray generator system with a cooling mechanism according to another embodiment of the present invention.

FIG. 2 schematically illustrates an x-ray source according to a second embodiment of the present invention. This system is similar to the first embodiment shown in FIG. 1, except for an additional system of heat exchange tubes enclosed in the enclosure 209. Like components are labeled with like numbers: The cathode 201, electron beam 202, alignment magnet unit 203, electromagnet unit (objective lens) 204, anode 205, x-ray 206A, vacuum tube (enclosure) 207, jet sprayer 208, heat exchange chamber 209, L-V PCM 210, PCM liquid jet 210A, and pump 211 perform the same functions as the corresponding components in the embodiment of FIG. 1.

The heat exchange tubes 212 are provided with fluid inlet and outlet 213 and 214, and a cooling fluid such as water circulates in the tubes. The surfaces of the tubes provide additional cool surfaces to condense the vapor of the L-V PCM inside the chamber 209, and the heat is carried away by the cooling fluid.

To summarize, because the anode of an x-ray tube becomes very hot during operation, metal can be used as the liquid to vapor phase change material to transfer the heat from the anode to a larger cool surface. A sprayer may be used to spray the liquid metal onto the back side of the anode where it evaporates. This system can effectively remove heat form the small area of the back of the anode.

It will be apparent to those skilled in the art that various modification and variations can be made in the x-ray generator structure and related method of the present invention without departing from the spirit or scope of the invention. Thus, it is intended that the present invention cover modifications and variations that come within the scope of the appended claims and their equivalents.

What is claimed is:

1. An x-ray generator comprising:
a cathode for emitting an electron beam;
an anode;
alignment and focusing units for focusing and directing the electron beam onto the anode;
a sealed x-ray tube enclosing the cathode, the anode and the alignment and focusing units;
a sealed heat exchange chamber joined to the x-ray tube, wherein the anode is in thermal contact with a section of a wall of the heat exchange chamber;
a metal as a liquid to vapor phase change material disposed inside the heat exchange chamber; and
a delivery mechanism for delivering a liquid of the metal onto the section of the wall of the heat exchange chamber,
wherein the metal is one that changes from a liquid to a vapor when in contact with the section of the wall of the heat exchange chamber when the electron beam is focused and directed onto the anode.

2. The x-ray generator of claim 1, wherein the delivery mechanism comprises a sprayer disposed inside the heat exchange chamber for spraying the liquid of the metal onto the section of the wall of the heat exchange chamber.

3. The x-ray generator of claim 2, wherein the delivery mechanism further comprises a pump for pumping the liquid to the sprayer.

4. The x-ray generator of claim 2, wherein the section of the wall of the heat exchange chamber is disposed horizontally at a top of the heat exchange chamber, and the sprayer is located below the section.

5. The x-ray generator of claim 2, wherein the section of the wall of the heat exchange chamber is disposed vertically.

6. The x-ray generator of claim 1, wherein the section of the wall of the heat exchange chamber is disposed substantially vertically, and wherein the delivery mechanism forms a falling film of the liquid metal over the section.

7. The x-ray generator of claim 1, further comprising heat exchange tubes disposed inside the heat exchange chamber and connected to a fluid inlet and a fluid outlet for flowing a cooling fluid within the tubes.

8. The x-ray generator of claim 1, wherein the metal is selected from a group comprising sodium (Na), potassium (K), tin (Sn), and their alloys.

9. An x-ray generator comprising:
a cathode for emitting an electron beam;
an anode;
alignment and focusing units for focusing and directing the electron beam onto the anode;

a sealed x-ray tube enclosing the cathode, the anode and the alignment and focusing units;

a sealed heat exchange chamber joined to the x-ray tube, wherein the anode forms a section of a wall of the heat exchange chamber;

a metal as a liquid to vapor phase change material disposed inside the heat exchange chamber; and a delivery mechanism for delivering a liquid of the metal onto the section of the wall of the heat exchange chamber, wherein the metal is one that changes from a liquid to a vapor when in contact with the section of the wall of the heat exchange chamber when the electron beam is focused and directed onto the anode.

10. The x-ray generator of claim 9, wherein the delivery mechanism comprises a sprayer disposed inside the heat exchange chamber for spraying the liquid of the metal onto the section of the wall of the heat exchange chamber.

11. The x-ray generator of claim 10, wherein the delivery mechanism further comprises a pump for pumping the liquid to the sprayer.

12. The x-ray generator of claim 10, wherein the section of the wall of the heat exchange chamber is disposed horizontally at a top of the heat exchange chamber, and the sprayer is located below the section.

13. The x-ray generator of claim 10, wherein the section of the wall of the heat exchange chamber is disposed vertically.

14. The x-ray generator of claim 9, wherein the section of the wall of the heat exchange chamber is disposed substantially vertically, and wherein the delivery mechanism forms a falling film of the liquid metal over the section.

15. The x-ray generator of claim 9, further comprising heat exchange tubes disposed inside the heat exchange chamber and connected to a fluid inlet and a fluid outlet for flowing a cooling fluid within the tubes.

16. The x-ray generator of claim 9, wherein the metal is selected from a group comprising sodium (Na), potassium (K), tin (Sn), and their alloys.

* * * * *